US012013201B2

(12) United States Patent
Roberts

(10) Patent No.: US 12,013,201 B2
(45) Date of Patent: Jun. 18, 2024

(54) BIPOD WITH SLING STUD MOUNT

(71) Applicant: Magpul Industries Corp., Austin, TX (US)

(72) Inventor: Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/115,033

(22) Filed: Feb. 28, 2023

(65) Prior Publication Data

US 2023/0204316 A1 Jun. 29, 2023

Related U.S. Application Data

(63) Continuation of application No. 17/702,981, filed on Mar. 24, 2022, now Pat. No. 11,624,577, which is a continuation of application No. 17/256,250, filed as application No. PCT/US2020/028498 on Apr. 16, 2020, now Pat. No. 11,320,226.

(60) Provisional application No. 62/835,333, filed on Apr. 17, 2019.

(51) Int. Cl.

| | |
|---|---|
| ***F41A 23/10*** | (2006.01) |
| ***F41C 23/02*** | (2006.01) |
| ***F41C 23/16*** | (2006.01) |

(52) U.S. Cl.

CPC ..... *F41A 23/10* (2013.01); *F41C 23/02* (2013.01); *F41C 23/16* (2013.01)

(58) Field of Classification Search

CPC ..... F41A 23/10; F41C 23/02; F41C 23/16; F41C 27/00

USPC ..... 42/94, 90, 72; 73/167

See application file for complete search history.

(56) References Cited

U.S. PATENT DOCUMENTS

| | | | |
|---|---|---|---|
| 2,771,699 | A | 11/1956 | Herter |
| 3,327,422 | A | 6/1967 | Harris |
| 3,999,461 | A | 12/1976 | Johnson et al. |
| 4,625,620 | A | 12/1986 | Harris |

(Continued)

FOREIGN PATENT DOCUMENTS

| | | | |
|---|---|---|---|
| CA | 3 132 383 | A1 | 10/2020 |
| CN | 204373500 | U | 6/2015 |

(Continued)

OTHER PUBLICATIONS

B&T Industries, LLC, "Atlas Bipods", 1 page, Online available at <http://www.accu-shot.com/Atlas_Bipods.php>, and retrieved on: Sep. 26, 2016.

(Continued)

*Primary Examiner* — Michael D David

(74) *Attorney, Agent, or Firm* — Neugeboren O'Dowd PC

(57) ABSTRACT

An interface for coupling a bipod to a sling stud of a firearm forend. The interface can include two pawls that pivot to release or grasp the sling stud. The pawls can be biased upward via a detent that rides within a vertical aperture in a pivot holder. The pivot holder can move up and down within a vertical aperture in a mounting plate of the interface, and via this movement the pawls may be forced open or closed. A bottom surface of one or both pawls can include an irregular surface different portions of which interface with a top of the detent depending on a vertical position of the pivot holder within the aperture in the mounting plate.

10 Claims, 14 Drawing Sheets

(56) References Cited

U.S. PATENT DOCUMENTS

| | | | | |
|---|---|---|---|---|
| 5,194,678 | A | 3/1993 | Kramer | |
| 5,402,595 | A | 4/1995 | Tamllos | |
| 7,431,247 | B2 * | 10/2008 | Bobro | F41A 23/10 248/176.1 |
| 7,571,563 | B2 | 8/2009 | Peterson | |
| 7,802,392 | B2 * | 9/2010 | Peterson | F41C 23/14 42/75.03 |
| 7,954,272 | B2 | 6/2011 | Potterfield et al. | |
| 8,056,277 | B2 | 11/2011 | Griffin | |
| 8,327,570 | B2 | 12/2012 | Potterfield et al. | |
| 8,402,684 | B1 | 3/2013 | Beltz | |
| 8,468,733 | B2 | 6/2013 | Deros | |
| 9,335,113 | B1 | 5/2016 | Chen | |
| 10,139,183 | B1 | 11/2018 | Liu | |
| 10,161,706 | B2 | 12/2018 | Roberts et al. | |
| 10,168,119 | B2 | 1/2019 | Roberts et al. | |
| 10,184,746 | B1 | 1/2019 | Liu | |
| 10,627,181 | B2 | 4/2020 | Roberts et al. | |
| 10,739,100 | B2 | 8/2020 | Roberts et al. | |
| 10,782,084 | B2 * | 9/2020 | Pop | F41A 23/10 |
| 11,320,226 | B2 * | 5/2022 | Roberts | F41C 23/16 |
| 11,391,533 | B2 * | 7/2022 | Favory | F41A 23/10 |
| 11,624,577 | B2 | 4/2023 | Roberts | |
| 2003/0192223 | A1 * | 10/2003 | Sharp | F41A 23/10 42/94 |
| 2006/0191183 | A1 | 8/2006 | Griffin | |
| 2007/0079541 | A1 | 4/2007 | Peterson | |
| 2008/0295379 | A1 | 12/2008 | Potterfield | |
| 2009/0000175 | A1 | 1/2009 | Potterfield et al. | |
| 2009/0126250 | A1 * | 5/2009 | Keng | F41A 23/10 42/94 |
| 2011/0126444 | A1 | 6/2011 | Keng et al. | |
| 2011/0214330 | A1 | 9/2011 | Potterfield et al. | |
| 2013/0031820 | A1 | 2/2013 | Deros | |
| 2015/0285583 | A1 | 10/2015 | Mayberry et al. | |
| 2015/0285584 | A1 | 10/2015 | Mayberry et al. | |
| 2018/0180374 | A1 | 6/2018 | Roberts et al. | |
| 2018/0216907 | A1 | 8/2018 | Roberts et al. | |
| 2019/0072355 | A1 | 3/2019 | Pop | |
| 2019/0086177 | A1 | 3/2019 | Roberts et al. | |
| 2019/0107355 | A1 | 4/2019 | Roberts et al. | |
| 2020/0217609 | A1 | 7/2020 | Roberts et al. | |
| 2021/0140738 | A1 | 5/2021 | Lynch | |
| 2022/0042760 | A1 | 2/2022 | Roberts | |
| 2022/0214130 | A1 | 7/2022 | Roberts | |

FOREIGN PATENT DOCUMENTS

| | | | |
|---|---|---|---|
| CN | 106440931 | A | 2/2017 |
| CN | 206709686 | U | 12/2017 |
| CN | 206832121 | U | 1/2018 |
| CN | 108478268 | A | 9/2018 |
| CN | 112534203 | A | 3/2021 |
| EP | 3 794 302 | A2 | 3/2021 |
| EP | 3 794 302 | B1 | 4/2022 |
| JP | 2021524573 | A | 9/2021 |
| JP | 6944086 | B2 | 10/2021 |
| TW | M488615 | U | 10/2014 |
| TW | 202140988 | A | 11/2021 |
| WO | 2020/214803 | A2 | 10/2020 |

OTHER PUBLICATIONS

Battenfeld Technologies, Inc., "Caldwell Shooting Bipod", 2 pages, Online available at <https://www.btibrands.com/product/shooting-bipod/>, retrieved on: Sep. 26, 2016.

Blackhawk!, "Sportster Traversetrack Bipod",7 pages, Online available at <https://blackhawk.com/products/long-gun-accessories/long-gun-accessories/bipods/sportster-traversetrack-bipod>, retrieved on: Sep. 26, 2016.

Bobro Engineering, "Bi-Pod Type 3—Blac", 1 page, Online available at <http://www.bobroengineering.com/view/product/1/>, retrieved on: Oct. 10, 2016.

Boltcarrier.com, "Knight's Armament (KAC) KAC Bi Pod Assembly", 1 page, Online available at <https://www.boltcarrier.com/product/kac-bi-pod/>, retrieved on: Sep. 26, 2016.

Bravo Company USA, "[Archived Thread]—which M-Lok Bipod Mount for Harris Brms on New Ruger Mpr?", 2 pages, Online available at <https://www.ar15.com/forums/ar-15/Which-M-LOK-bipod-mount-for-Harris-BRMS-on-new-Ruger-MPR419-718331/>, retrieved on: Sep. 27, 2017.

Brownells, Inc., "GPS, LLC.—Military Model Grip Pod Picatinny Mount", 2 pages, Online available at <https://www.brownells.com/shooting-accessories/bipods-monopods-amp-accessories/bipod-accessories/grip-pod-gps-02-military-model-prod244>, retrieved on: Sep. 26, 2016.

Command Arms Accessories, "Bipod 6 in -8 in Rail NPBS", 1, page, Online available at <https://web.archive.org/web/20160303002441/http://store.commandarms.com/products/NBPS.html>, retrieved on: Mar. 12, 2019.

Decision to Grant received for Japanese Patent Application Serial No. 2021503164 dated Aug. 10, 2021, 5 pages.

Extended European Search Report received for European Patent Application Serial No. 20791288.2 dated Jun. 16, 2021, 5 pages.

Fidelis Firearms, "Parker-Hale Bipods", 1 page, Online available at <http://fidelisfirearms.com/bipods/>, retrieved on: Sep. 26, 2016.

First Office Action received for Chinese Patent Application Serial No. 202080004017.8 dated Jul. 18, 2022, 19 pages (10 pages of English translation and 9 pages of official copy).

Galleon.PH, "Tiptop Ez Pivot & Pan Rifle Bipod 6"-9": Sling Stud Mount: Extendable, Rolding, with Sling-Attached Hole PN# S7-74667", pp. 22, Online available at <https://www.galleon.ph/sports-outdoors-c891/hunting-fishing-c961/shooting-c960/gun-accessories-maintenance-storage-c959/monopods-bipods>, retrieved on: Mar. 5, 2020.

GG&G, "Standard XDS Bipod", 4 pages, Online available at <http://www.gggaz.com/standard-xds-swivel-bipod.html>, retrieved on: Sep. 26, 2016.

Harris Bipods, "Harris Bipods And Adapters", 8 pages, Online available at <http://www.harrisbipods.com/>, retrieved on: Sep. 26, 2016.

hkparts.net, "HK German Rifle all Steel Bipod—for Use with the HK Wide Forearm", 2 pages, Online available at <http://www.hkparts.net/shop/pc/HK-German-All-Steel-Bipod-G3-91-93-33-p215.htm>, retrieved on: Sep. 26, 2016.

Intention to grant received for European Patent Application Serial No. 20791288.2 dated Nov. 8, 2021, 6 pages.

International Preliminary Report on Patentability Chapter I Received for International PCT Application Serial No. PCT/US2020/028498 dated Oct. 28, 2021, 6 pages.

International Search Report and Written Opinion Received for International PCT Application Serial No. PCT/US2020/028498 dated Oct. 29, 2020, 11 pages.

KFS Industries, Inc., "S7 Bipods", 2 pages, Online available at <http://s7bipod.com/>, retrieved on: Sep. 26, 2016.

KFS Industries, Inc., "Versa-Pod", 2 pages, Online available at <http://stores.versapod.com/>, retrieved on: Sep. 26, 2016.

Leapers, Inc., "Bipods and Shooting Stands", 3 pages, Online available at <https://leapers.com/index.php?mitem=bipod&mtrack=m>, retrieved on: Oct. 10, 2016.

Mcquay, John, "Caldwell Xla Pivot Model Bipod Review", 6 pages, Online available at <http://8541tactical.com/2018/12/15/caldwell-xla-pivot-model-bipod-review/>, and retrieved on: Dec. 15, 2018.

Midwest Gun Works, Inc., "Sako TRG 22/42 Bipod", 2 pages, Online available at <https://www.midwestgunworks.com/page/mgwi/prod/55740495?>, retrieved on: Sep. 26, 2016.

Military Advantage, "M249 Squad Automatic Weapon", 3 pages, Online available at <https://www.military.com/equipment/m249-squad-automatic-weapon>, retrieved on: Sep. 26, 2016.

Notice of Allowance received for Canadian Patent Application Serial No. 3132383 dated Mar. 14, 2022, 37 pages.

Notice of Allowance received for U.S. Appl. No. 17/256,250 dated Jan. 21, 2022, 46 pages.

Notice of Allowance received for U.S. Appl. No. 17/702,981 dated Dec. 1, 2022, 104 pages.

Notice of Allowance received for U.S. Appl. No. 17/702,981 dated Oct. 26, 2022, 37 pages.

(56) References Cited

OTHER PUBLICATIONS

Office Action received for Taiwanese Patent Application Serial No. 110109581 dated Apr. 26, 2022, 4 pages.
Sarco, Inc., "M60 US GI Bipod", 2 pages, Online available at <http://www.e-sarcoinc.com/m60bipod.aspx>, retrieved on: Sep. 26, 2016.
The Mako Group, "Tactical Vertical Foregrip with Integrated Adjustable Bipod—GEN 2—T-PODG2QR", 4 pages, Online available at <https://www.themakogroup.com/foregrips/tactical-vertical-foregrip-with-integrated-adjustable-bipod-gen-2-t-podg2qr.html>, retrieved on: Sep. 26, 2016.
The Mako Group, "Tavor Quick Deployment Bipod", 3 pages, Online available at <https://www.themakogroup.com/tavor-quick-deployment-bipod-4462.html>, retrieved on: Sep. 26, 2016.
Vanguard, "Equalizer Pro 2", 5 pages, Online available at <https://www.vanguardworld.us/hunting_us/products/support-systems/equalizer-pro-2.html#/go-sectionTop>, retrieved on: Sep. 26, 2016.
vepr.org, "VEPR 7.62 X 54R Mounting a Harris Bipod", 2 pages, Online available at <http://www.vepr.org/ iiewtopic.php?f=13&t=4323>, retrieved on: Jun. 21, 2015.

* cited by examiner

BIPOD WITH SLING STUD MOUNT

CLAIM OF PRIORITY UNDER 35 U.S.C. § 119

The present Application for patent is a Continuation of U.S. patent application Ser. No. 17/702,981 entitled "BIPOD WITH SLING STUD MOUNT" filed Mar. 24, 2022, which is a Continuation of U.S. patent application Ser. No. 17/256,250 entitled "BIPOD WITH SLING STUD MOUNT" filed Dec. 28, 2020 and issued on May 3, 2022 as U.S. Pat. No. 11,320,226, which is a 371 of International Patent Application No. PCTUS2020028498 entitled "BIPOD WITH SLING STUD MOUNT" filed Apr. 16, 2020, which claims priority to Provisional Application No. 62/835,333 entitled "BIPOD WITH SLING STUD MOUNT" filed Apr. 17, 2019, and assigned to the assignee hereof and hereby expressly incorporated by reference herein.

FIELD OF THE DISCLOSURE

The present disclosure relates generally to bipods. In particular, but not by way of limitation, the present disclosure relates to systems, methods and apparatuses for a bipod configured for coupling to a sling stud mount of a firearm.

DESCRIPTION OF RELATED ART

Modern firearms, such as rifles in particular, may be more accurately and conveniently fired by the shooter if the firearm is equipped with a bipod device for supporting and steadying the barrel. Bipods may be fixedly or removably mounted onto firearms, and have been found to be most convenient if they can further be retracted in a storage position when not in use. Exemplary bipods and mounting devices are taught in prior U.S. Pat. No. 3,327,422 issued Jun. 27, 1967; U.S. Pat. No. 4,470,216 issued Sep. 11, 1984; U.S. Pat. No. 4,625,620 issued Dec. 2, 1986; and U.S. Pat. No. 4,641,451 issued Feb. 10, 1987; U.S. Pat. No. 4,903,425 issued Feb. 27, 1990; and U.S. Pat. No. 5,711,103 issued Jan. 27, 1998, and U.S. Pat. No. 7,779,572 issued Aug. 24, 2010, the disclosures of which are incorporated herein by reference in their entirety.

Existing bipods attach to firearms via a number of interfaces including M-LOK, NATO Rail, Picatinny Rail, and the sling stud. The Harris Bipod is one very common bipod that attaches to the sling stud, but tends to be finicky and difficult to install. Thus, there is a need for a simpler and more secure method of attaching a bipod to a sling stud, and one that is quicker and less prone to mounting errors.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

The present disclosure relates generally to a bipod-to-firearm interface for a sling stud (or sling swivel stud). More specifically, but without limitation, the present disclosure relates to a bipod having a firearm forend interface, a sling stud clasp assembly optionally including spring-loaded pawls that open and close to grasp a firearm's sling stud, and these pawls being biased toward an open position, and opening and closing of the sling stud clasp assembly being effected by rotation of a sling stud locking mechanism coupled to the sling stud clasp assembly. The sling stud clasp assembly can be arranged below and partially passing up and through an aperture in a mounting plate. The sling stud locking mechanism can be positioned below the firearm forend interface, and in some instances can include a rotating knob having a threading relationship to the sling stud clasp assembly. More specifically, the sling stud clasp assembly can include spring-loaded pawls that pivot on a pivot axis. The pivot axis can be held within a pivot holder having outer threads on a lower portion thereof that can threadingly couple to inner threads of the rotating knob. Accordingly, when the knob is rotated in a first direction, the pivot holder is pulled downward relative to the knob and mounting plate and consequently, the pivot axis and the spring-loaded pawls are also pulled downward relative to the knob and mounting plate. As the spring-loaded pawls are pulled downward through the aperture in the mounting plate they are pressed inward and can pivot or close on a sling stud thereby grasping and locking the sling stud to the bipod-to-firearm interface (e.g., see FIGS. 10-11). Rotating the rotating knob in a second direction forces the sling stud clasp assembly upward allowing the spring-loaded pawls to pivot outward as they clear a top of the aperture in the mounting plate. The pivot holder and the knob can be concentrically arranged around a vertical axis that also passes through a center of the sling stud (in other words, the knob and pivot holder are aligned along a common axis with the sling stud).

The firearm forend interface can include its own sling stud, for instance, extending rearward from a back of the firearm forend interface. This sling stud of the bipod can enable sling stud access for the user since the firearm's forend sling stud is used to mount the bipod and thus isn't available for a sling or other accessory attachment.

Generally, the bipod can include a housing with two leg assemblies attached thereto. The housing can include an aperture through which passes a pivot rod, the pivot rod having a threaded coupling to a locking knob arranged below the housing, wherein turning of the locking knob results in the pivot rod moving up or down along a vertical axis passing through the pivot rod and the housing. A top of the pivot rod can be coupled to a cant nut having a tubular shape and a longitudinal axis perpendicular to the vertical axis. A firearm forend interface can include an aperture having a similar shape to the cant nut, and the cant nut arranged within this aperture in the firearm forend interface. The firearm forend interface can rotate or cant around the cant nut to provide canting to a firearm mounted to the firearm forend interface. A pivot block can be arranged between the housing and the firearm forend interface and can pivot atop the housing. The pivot block can include a concave hollow into which a portion of a bottom of the firearm forend interface is shaped to rest in such that when the locking knob is tightened, the pivot block and firearm forend interface pivot in unison. Rotation of the locking knob pushes the cant nut and thereby the firearm forend interface up or down to lock or unlock the firearm forend interface into the concave hollow in the pivot block. The firearm forend interface can be shaped to fit a variety of known and yet-to-be-known accessory interfaces, such as, but not limited, to M-LOK, Picatinny rail, and NATO rail.

Some embodiments of the disclosure may be characterized as a bipod assembly comprising a firearm forend interface, a pivot holder, two pawls, and a sling stud locking mechanism. The firearm forend interface can have a vertical aperture shaped to receive the pivot holder. The pivot holder can be shaped to slidingly move vertically with the vertical aperture in the firearm forend interface. The two pawls can be pivotally coupled to each other and pivotally coupled to the pivot holder via a pivot pin. The sling stud locking mechanism can be threadingly coupled to the pivot holder and can be configured to cause the vertical movement of the pivot holder via rotation of the sling stud locking mechanism. Upward vertical movement of the pivot holder can cause opening of the two pawls, whereas downward vertical movement of the pivot holder can cause closing of the two pawls.

Other embodiments of the disclosure can be characterized as a firearm assembly. The assembly may comprise a firearm having a forend, a firearm forend interface, a pivot holder, two pawls, and a sling stud locking mechanism. The firearm forend interface can be configured for coupling to a bottom of the forend and may have a vertical aperture shaped to receive a pivot holder. The pivot holder may be shaped to slidingly move vertically within the vertical aperture in the firearm forend interface. The two pawls may be pivotally coupled to each other and to the pivot holder via a pivot pin. The sling stud locking mechanism may be threadingly coupled to the pivot holder and configured to, via rotation of the sling stud locking mechanism, cause the vertical movement of the pivot holder. The movement of the pivot holder within the vertical aperture in a first direction may cause opening of the two pawls, and movement of the pivot holder within the vertical aperture in a second direction may cause closing of the two pawls.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The word "exemplary" is used herein to mean "serving as an example, instance, or illustration." Any embodiment described herein as "exemplary" is not necessarily to be construed as preferred or advantageous over other embodiments.

Figure 1:
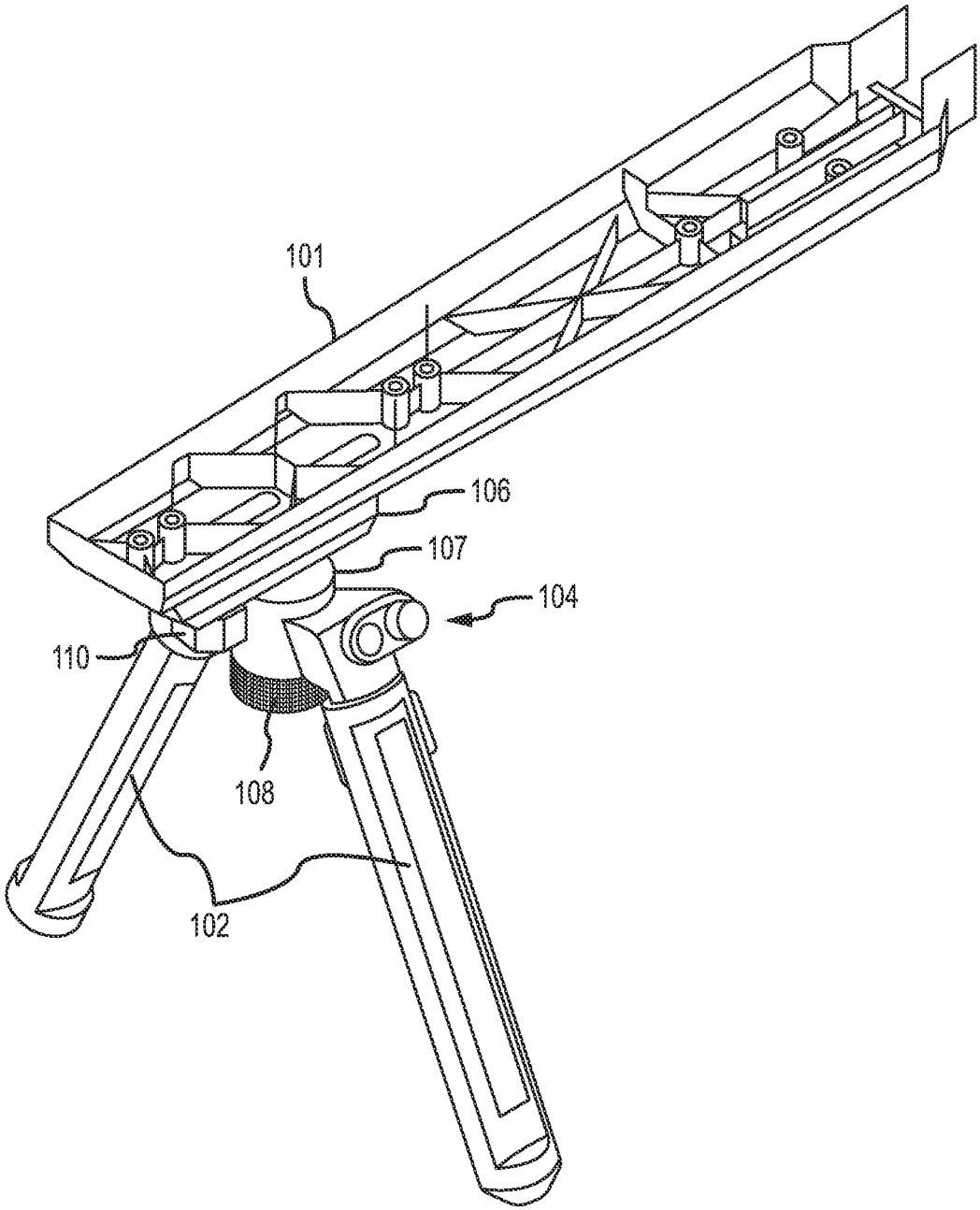
FIG. 1 shows a perspective view of an embodiment of the herein disclosed bipod coupled to a generic firearm forend.
Figure 2:
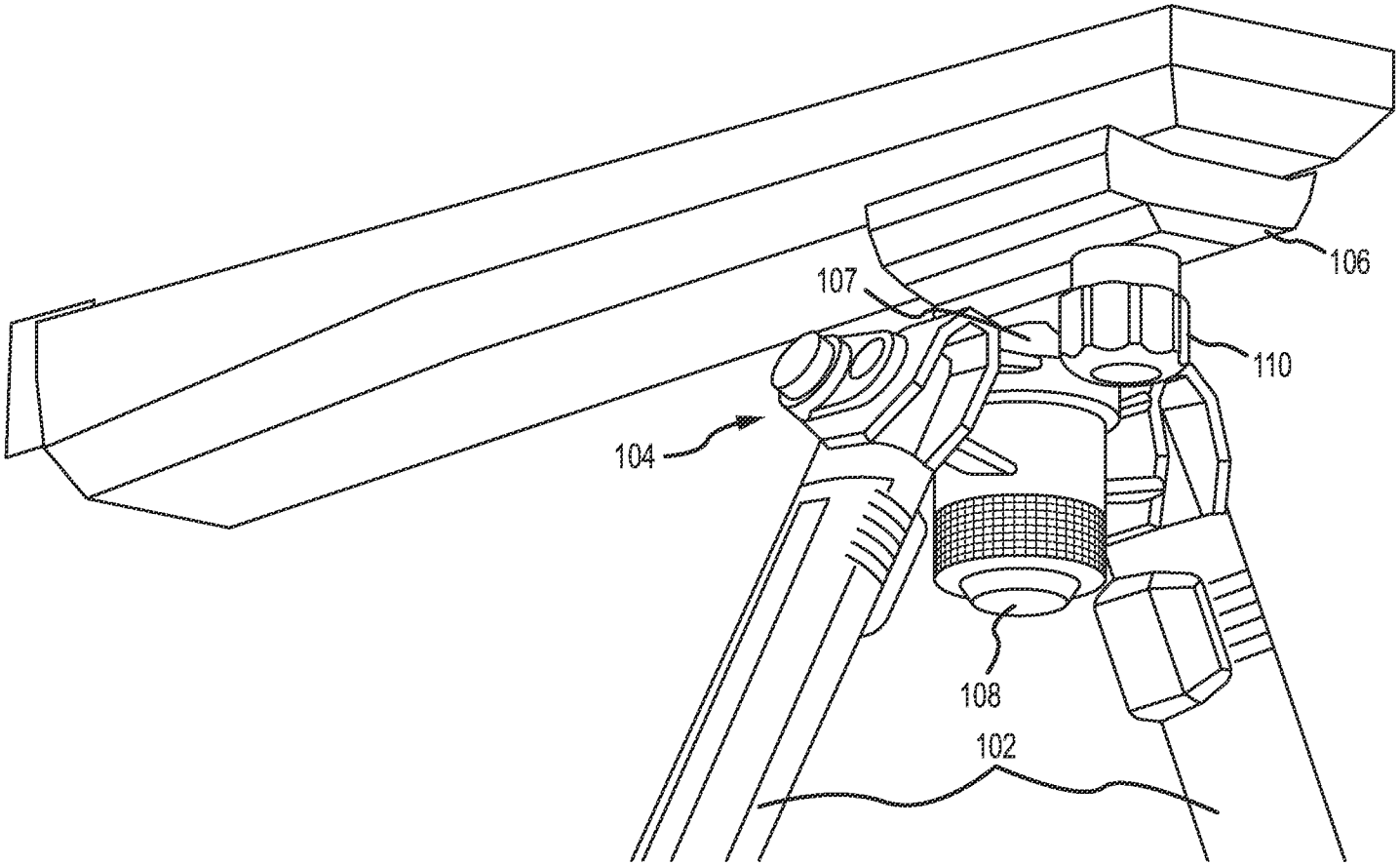
FIG. 2 shows another perspective view of an embodiment of the herein disclosed bipod coupled to a generic firearm forend.

FIGS. 1 and 2 show perspective views of an embodiment of the herein disclosed bipod coupled to a generic firearm forend 101. The bipod enables selective and lockable cant and pivoting and interfacing with a firearm, such as a rifle, via one of various known interfacing platforms (e.g., M-LOK, NATO Rail, Picatinny). The legs can also telescope and be stored in a position folded up and back to a position near the forend 101 of the firearm and parallel to the barrel (e.g., rotated roughly 90° from a deployed position). The bipod can further include legs 102 rotationally coupled to a housing 104. The housing 104 can include a pivot block 107 that couples to the firearm forend interface 106. In this embodiment, the firearm forend interface 106 is configured for interfacing with a firearm, handguard of a firearm, etc. via the sling stud platform. A sling stud locking mechanism 110, arranged below the firearm forend interface 106, can rotate in a first direction to loosen the bipod from the sling stud and allow the bipod to be removed from the firearm. Rotating the sling stud locking mechanism 110 in a second direction can tighten a coupling between the bipod and the sling stud of the firearm to secure the bipod to the firearm. The firearm forend interface 106 can couple to the housing 104 via the pivot block 107. In other embodiments this coupling can include different degrees of rotational freedom (e.g., cant and pivot to name two). In the illustrated embodiments, structures to allow cant and pivot between the housing 104 and the firearm forend interface 106 are shown, but these are not intended to limit the scope of the disclosure.

The legs 102, housing 104, locking knob 108, and pivot block 107 are substantially the same as described in U.S. Pat. Nos. 10,161,706 and 10,168,119, and those disclosures are hereby incorporated by reference in their entirety.

Figure 3:
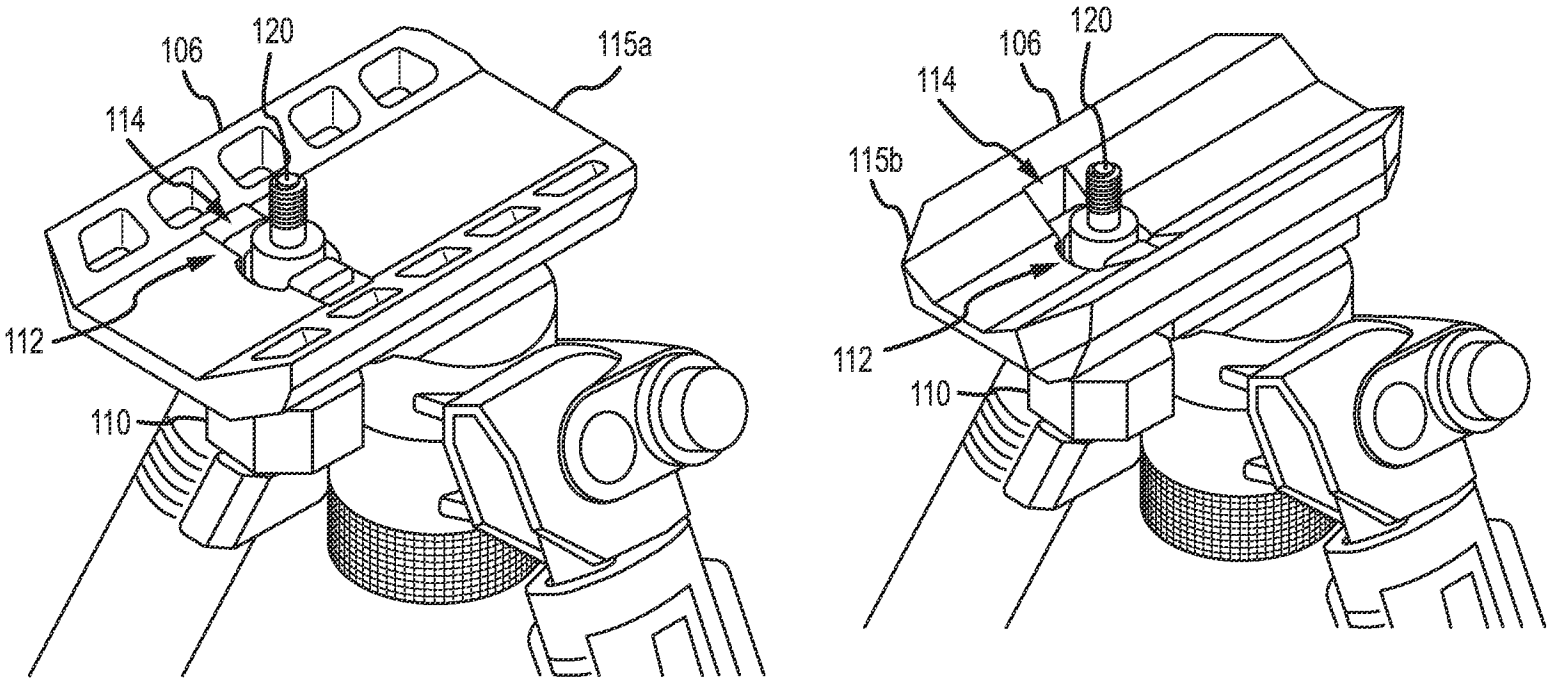
FIG. 3 shows two flanges that can be used on the bipod shown in FIGS. 1 and 2.
Figure 4:
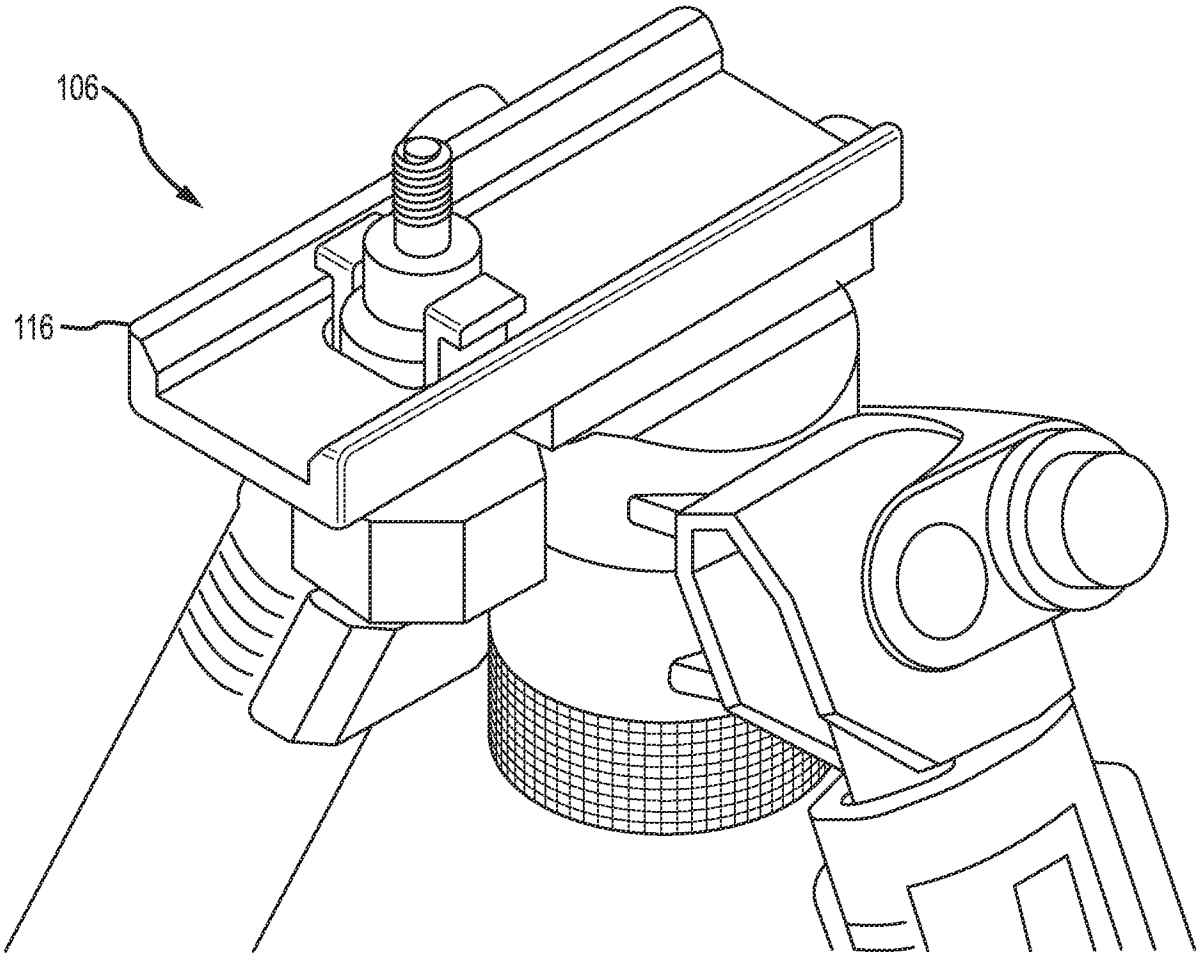
FIG. 4 shows a view of the bipod without a flange.
Figure 5:
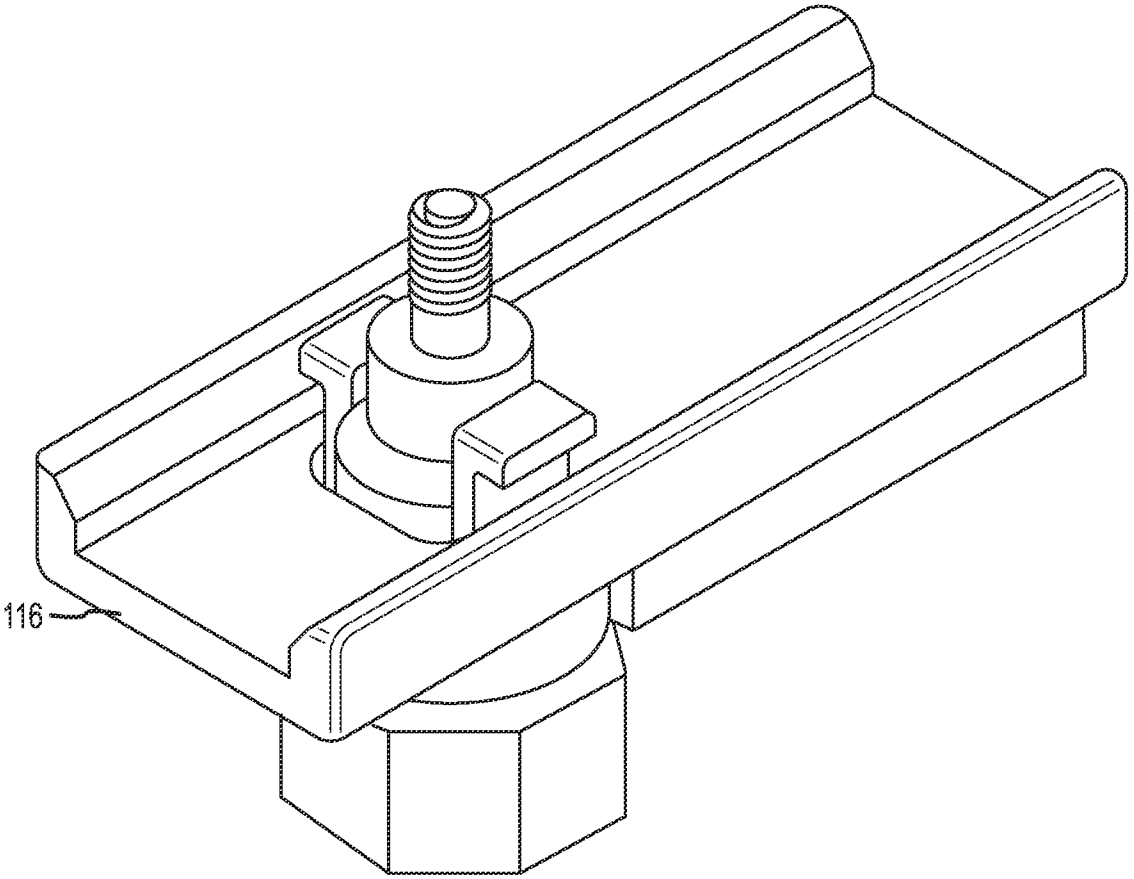
FIG. 5 shows a detailed view of the bipod interfacing with a sling stud of a firearm.
Figure 10:
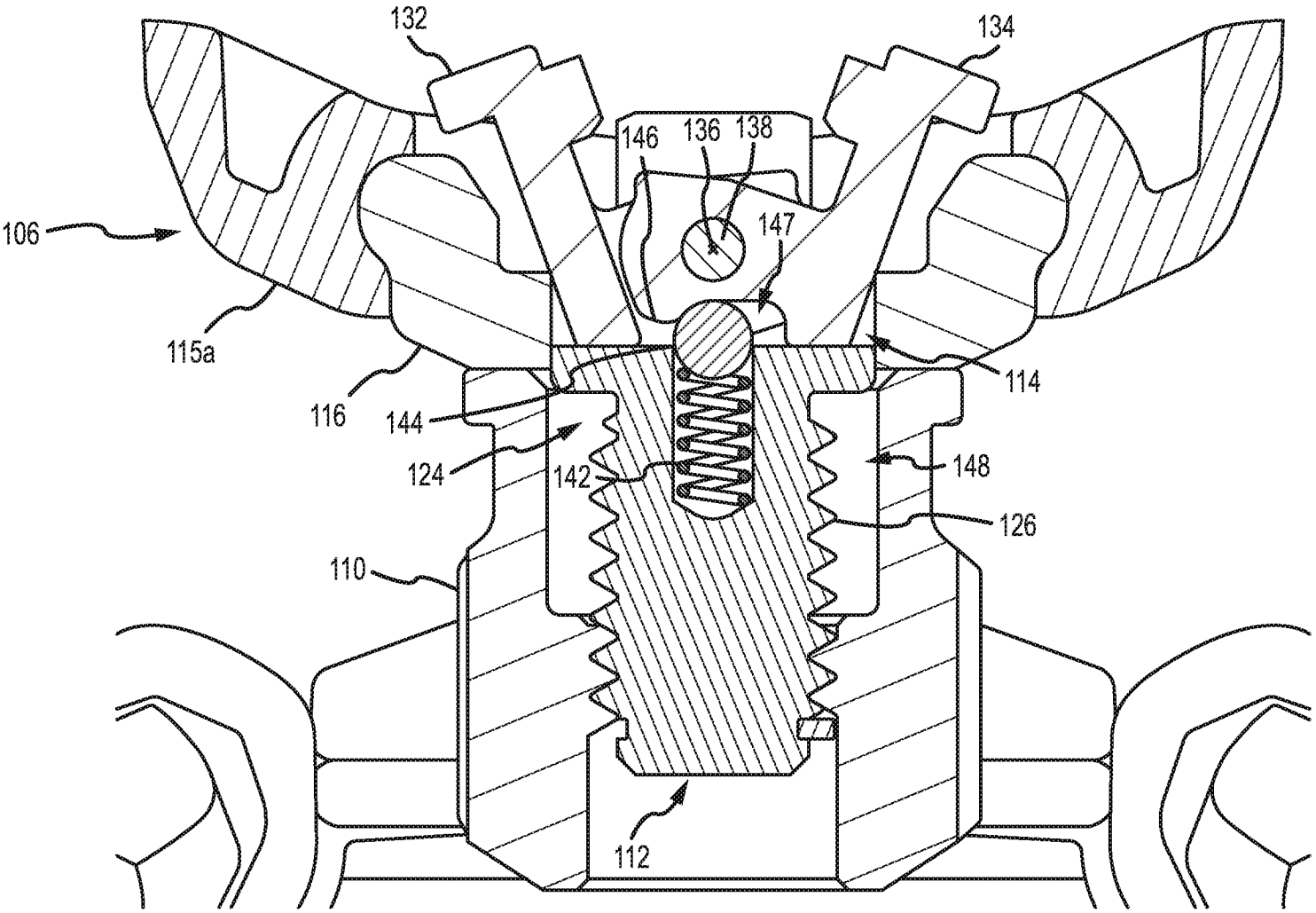
FIG. 10 shows the sling stud clasp assembly in the open position, without a sling stud shown.
Figure 11:
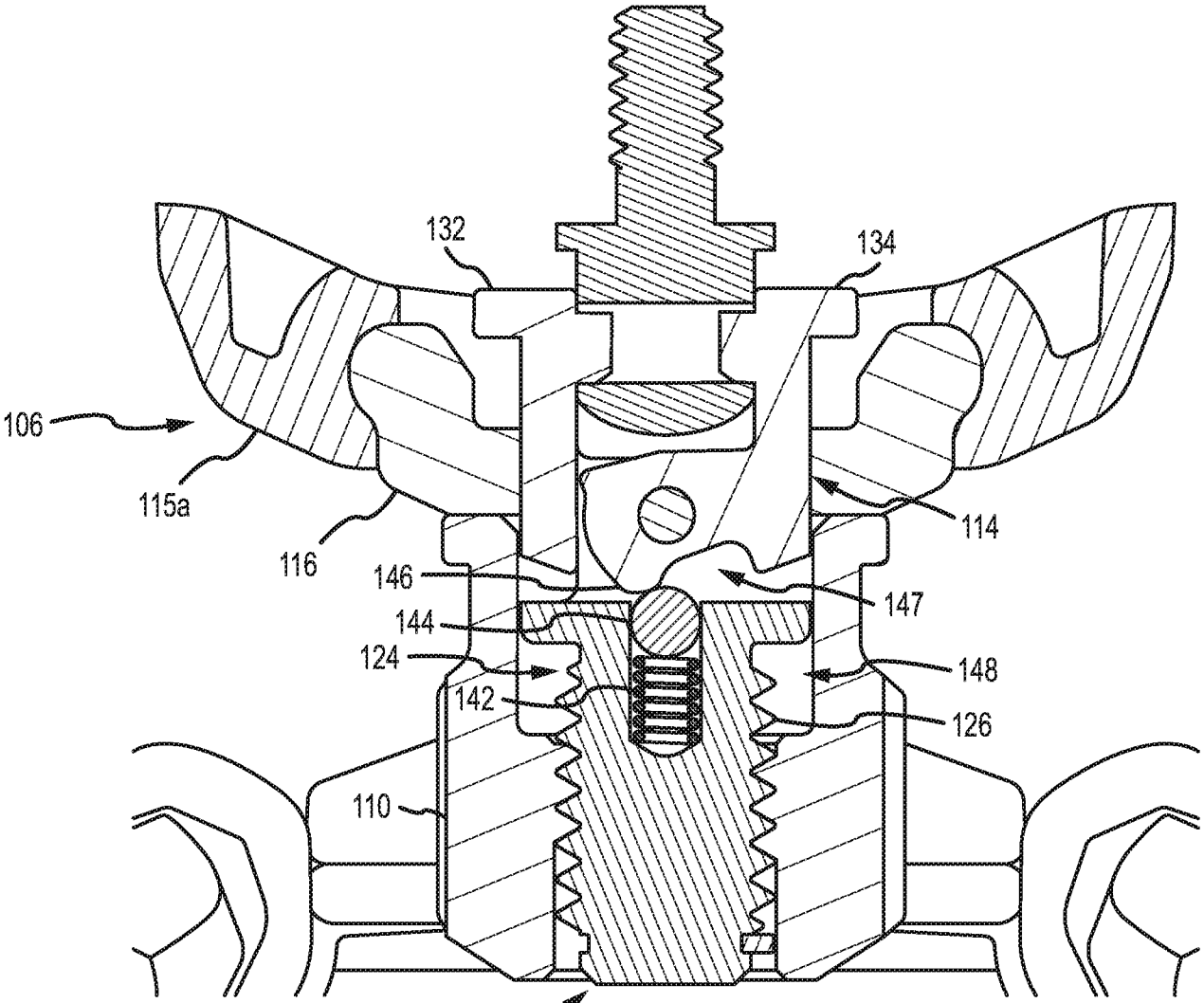
FIG. 11 shows the sling stud clasp assembly in the closed position and grasping the firearm sling stud.

FIGS. 3-5 show a sling stud clasp assembly 112 coupled to a sling stud, such as a sling stud that was used to couple the forend 101 to the bipod in FIG. 1. The sling stud clasp assembly 112 is arranged within an aperture 114 in the firearm forend interface 106 and is rotatably coupled to and controlled by a sling stud locking mechanism 110 (e.g., a rotating knob) below a front overhanging portion of the firearm forend interface 106. FIGS. 10 and 11 show a cross section of the same. FIGS. 3-5 exclude the firearm to make it easier to view portions of the bipod that are otherwise obscured from view. However, a sling stud 120 of the firearm is still visible to illustrate interaction with the sling stud clasp assembly 112 (shown in a "closed" or "locked" position or state). The sling stud clasp assembly 112 is arranged through an aperture 114 in the firearm forend interface 106 (this aperture is more easily seen in FIGS. 10 and 11). The aperture 114 can extend through the firearm forend interface 106, from a top to a bottom of the firearm forend interface 106, and the sling stud clasp assembly 112 can pass through this aperture 114 to couple to the sling stud locking mechanism 110 (e.g., via a threaded engagement). For instance, the sling stud locking mechanism 110 can form a rotational coupling to the sling stud clasp assembly 112 (the sling stud locking mechanism 110 can rotate, which in turn causes the sling stud clasp assembly 112 to move up and down). The sling stud locking mechanism 110 can be moved toward a locked position (e.g., via rotation in a first direction) to move the sling stud clasp assembly 112 from an open to a closed position and thereby lock it onto the firearm sling stud 120. This motion can overcome a bias on the sling stud clasp assembly 112, caused by a biasing component 142 and detent 144, and force the sling stud clasp assembly 112 toward the closed position. For instance, rotation of the sling stud locking mechanism 110 in a first direction can cause a pair of spring-loaded pawls 132, 134 of the sling stud clasp assembly 112 (see FIGS. 6-12) to close or rotate inward around a pivot axis 136 (see FIG. 7). Rotation, especially via a threaded engagement, can effect a large torque able to overcome the bias from the biasing component 142 that otherwise forces the pawls 132, 134 toward an open position in which they are not in contact with the firearm sling stud 120. Further details describing opening and closing of the pawls 132, 134 can be seen in FIGS. 10-12.

In some embodiments, the firearm forend interface 106 can comprise two components: a soft flange (not shown in FIG. 4, but visible as 115 in FIGS. 3 and 10-11) and a mounting plate 116 (shown in FIGS. 4 and 10-11). The mounting plate 116 can couple to a bottom of the soft flange 115 and can interface the firearm forend interface 106 to the rest of the bipod (e.g., to the pivot block 107). In some cases, the mounting plate 116 can include structure for cant movement relative to the bipod housing (i.e., rotation around an axis parallel with the longitudinal axis of the firearm barrel).

FIG. 5 illustrates another view of the mounting plate 116, but with the soft flange 115 removed.

FIG. 3 also shows two variations of the firearm forend interface 106: a version having a wider soft flange 115*a* (left) and a version having a narrower soft flange 115*b* (right). These and other firearm forend interfaces 106 can be adapted to different sizes and shapes of firearm forends, and are non-limiting. The soft flange 115 can be formed from rubber, cloth, polymer, or any other material unlikely to scratch the forend of the rifle that the bipod is being attached to (e.g., wooden forends).

Figure 6:
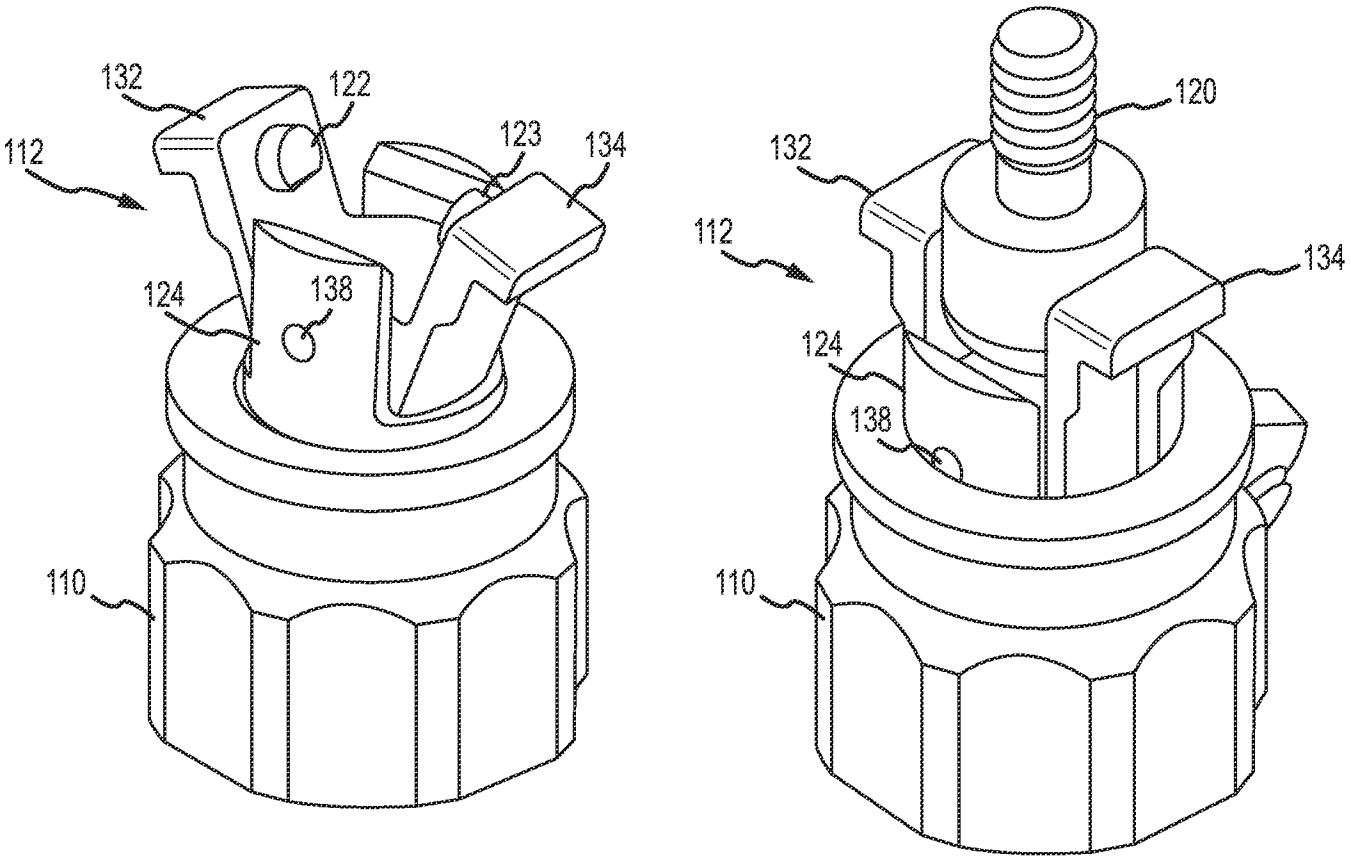
FIG. 6 illustrates details of the sling stud clasp assembly and the sling stud locking mechanism.
Figure 7:
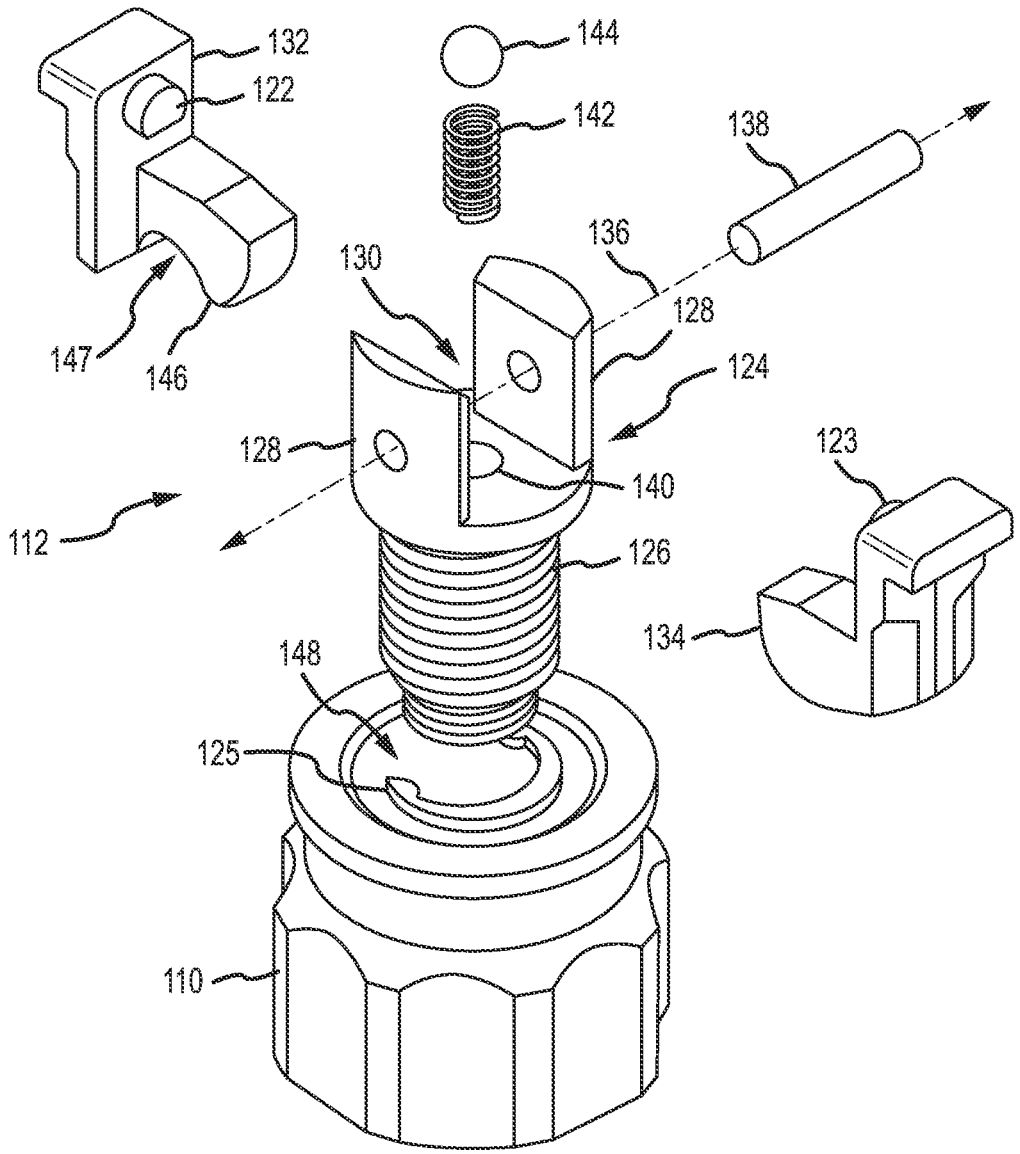
FIG. 7 illustrates a detailed and exploded view of the sling stud clasp assembly and the sling stud locking mechanism.

FIG. 6 illustrates details of the sling stud clasp assembly 112 and the sling stud locking mechanism 110. The left figure shows the sling stud clasp assembly 112 in the open position, and the right figure shows the sling stud clasp assembly 112 in the closed position and clamped to a firearm sling stud 120. The sling stud locking mechanism 110 can also include a first spring-loaded pawl 132 and a second spring-loaded pawl 134 both rotatably coupled to a pivot holder 124 via a pivot pin 138 passing along a pivot axis 136 parallel to a longitudinal axis of the firearm barrel. The spring-loaded pawls 132, 134 can each include protrusions 122, 123 shaped to enter an opposing side of an aperture in the firearm sling stud 120 when the pawls 132, 134 close upon the firearm sling stud 120. The pivot holder 124 can also include a threaded lower portion 126, the cylindrical upper portion 128, and a pawl-holding recess 130 within the cylindrical section 128 (see FIG. 7). The pawl-holding recess 130 can be shaped and sized to receive at least a portion of both of the pawls 132, 134. An outer diameter of the cylindrical section 128 can have a similar (or just smaller) diameter than an inner diameter of a lock aperture 148 through the sling stud locking mechanism 110. This enables the cylindrical section 128 to slide vertically within the lock aperture 148. The pivot axis 136 and pivot pin 138 can pass through the pawls 132, 134, the cylindrical section 128 of the pivot holder 124, and the pawl-holding recess 130. Accordingly, when the sling stud locking mechanism 110 is rotated, inner threads thereof interface with outer threads of the threaded lower portion 126 causing the pivot holder 124 to move upward or downward within the lock aperture 148. This movement pulls the pivot pin 138 with the pivot holder 124 which in turn pulls the pawls 132, 134 up and down, which causes opening and closing of the pawls 132, 134.

Figure 12A:
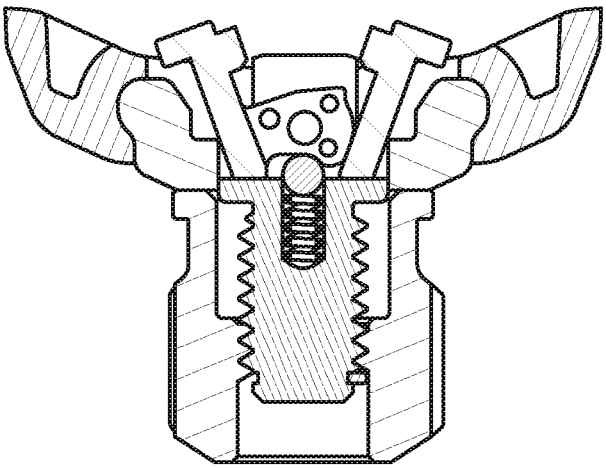
FIG. 12A shows a first position of the pawls in the sling stud clasp assembly.
Figure 12B:
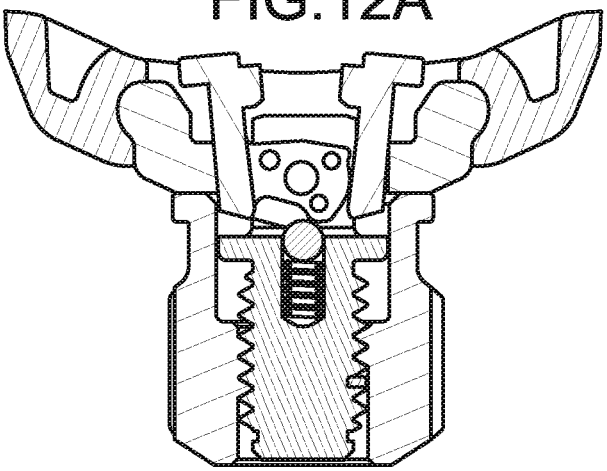
FIG. 12B shows a second position of the pawls in the sling stud clasp assembly.
Figure 12C:
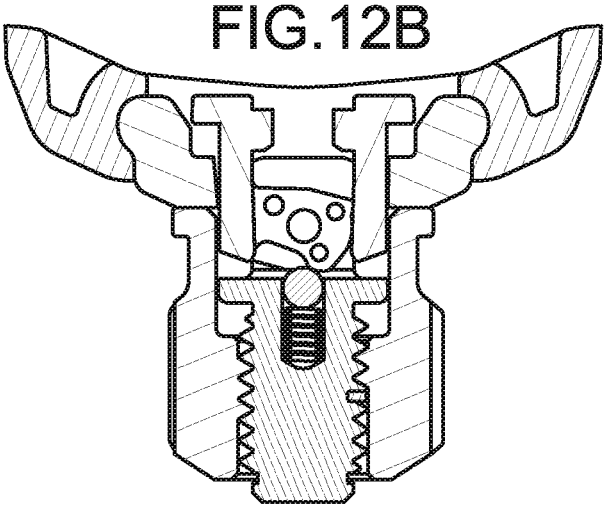
FIG. 12C shows a third position of the pawls in the sling stud clasp assembly.

The loosening and tightening of the sling stud clasp assembly 112 is best seen in FIGS. 10-12. Notably, the cross section in FIG. 10 shows the sling stud clasp assembly 112 in the open position, without a sling stud shown, and FIG. 11 shows the sling stud clasp assembly 112 in the closed position and grasping the firearm sling stud 120. One or both of the spring-loaded pawls 132, 134 can include an irregular bottom surface, and different portions of this irregular bottom surface are presented to and contact the detent 144 as the pivot holder 124 moves within the aperture 114. In turn, this contact leads to different torques applied to the pawls 132, 134. More specifically, the irregular surface can include one or both of a pawl detent 146 and a pawl groove 147. Both the pawl detent 146 and the pawl groove 147 can include curved surfaces and the pawl groove 147 can be closer to the pivot axis 136 than the pawl detent 146. In other words, a first radius from the pawl detent 146 to the pivot axis 136 can be greater than a second radius from the pawl groove 147 to the pivot axis 136. However, the pawl detent 146 and/or pawl groove 147 can include one or more straight surfaces as well, or one or more straight surfaces joined by beveled edges, corners, or jogs. The pawl detent 146 can be arranged toward an outside of each pawl 132, 134. The detent 144 can interact with the pawl groove 147 when the spring-loaded pawls 132, 134 are in the open position as well as with an inside side of the detent 146 (see FIG. 12A), and can interact solely with the pawl detent 146 when the pawls 132, 134 are in the closed position (see FIG. 12C).

Figure 8:
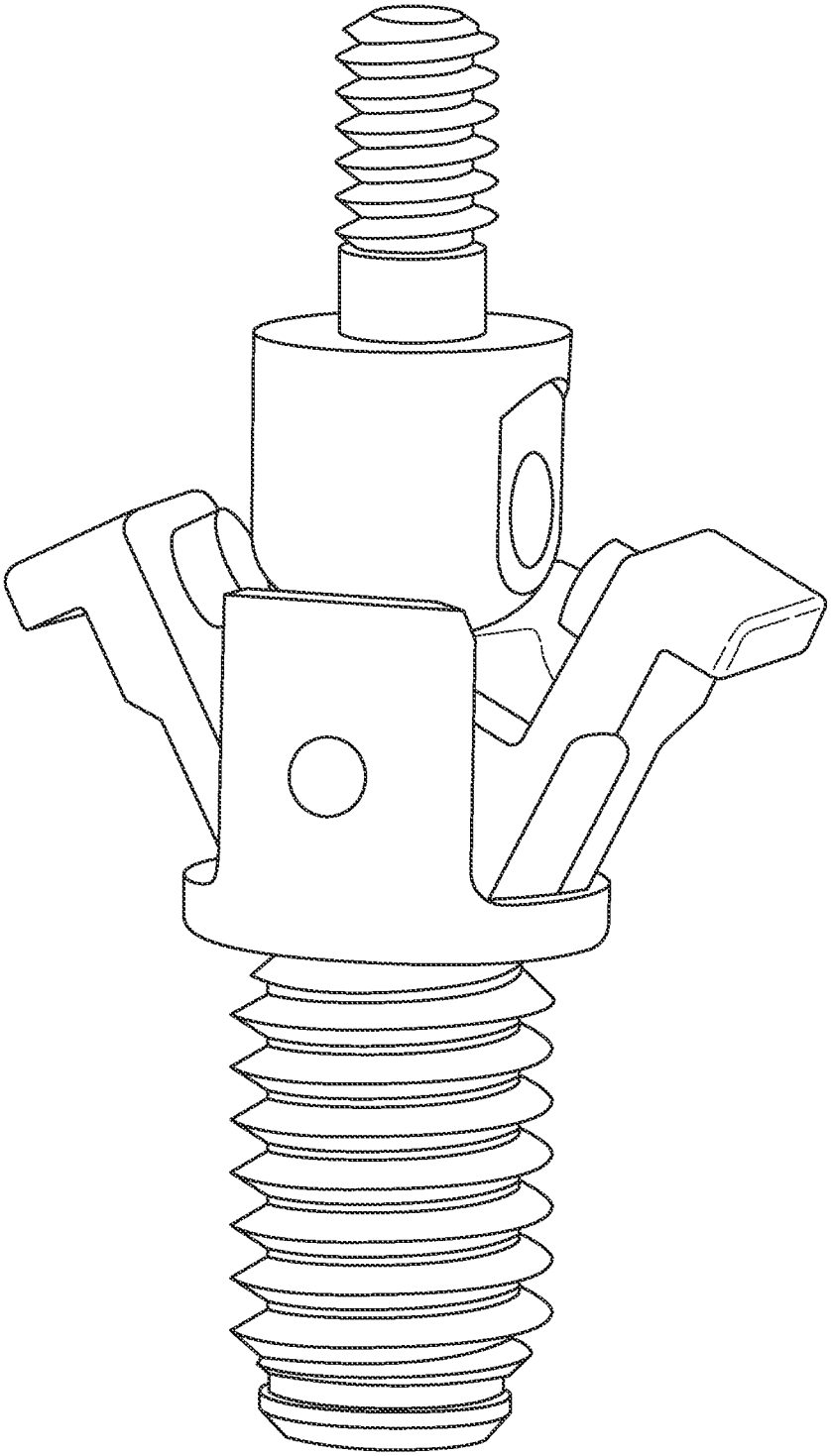
FIG. 8 illustrates the pivot holder, pivot pin, and pawls in isolation with a sling stud.

FIG. 12 shows opening and closing of the pawls in three stages from open (FIG. 12A) to closed (FIG. 12C). In the open position the pawl groove 147 is in contact with a top of the detent 144 and the detent 144 is in a topmost position of the three stages shown in FIG. 12. Here the pawls 132, 134, via the pawl groove 147, apply little if any pressure downward on the top of the detent 144. The detent 144 can be arranged partially in the vertical aperture 140 and partly in the pawl-holding recess 130. A biasing component 142 (e.g., a spring) can also be arranged in the vertical aperture between a bottom of the detent 144 and a bottom of the vertical aperture 140. However, this position of the biasing component is not limiting. This biasing component 142 can apply a bias on the detent 144 tending to push it upward toward the pawls 132, 134. The knob 110, the pivot holder 124, and the vertical aperture 140 can all be aligned along a common axis that passes through a center of the sling stud (as best seen in FIG. 8). This axis may also pass through the detent 144, and the detent 144 may move up and down along this axis.

Specifically, as the sling stud locking mechanism 110 is rotated in a first direction, the threaded portion 126 of the pivot holder 124 threadingly engages inner threads of the sling stud locking mechanism 110 and this interaction pulls the pivot holder 124 downward. Downward movement of the pivot holder 124 brings the pivot pin 138 with it, and with this comes the spring-loaded pawls 132, 134 (see FIG. 12B). As the spring-loaded pawls 132, 134 are pulled downward with the pivot holder 124, the sides of the pawls 132, 134 contact edges of the aperture 114 in the mounting plate 116 and this gradually forces the pawls 132, 134 inward. At the same time, as the pawls 132, 134 rotate, the pawl detent 146 pivots downward relative to the pivot axis 136 and begins to interface with and press down on a top of the detent 144. This causes the biasing component 142 to become compressed and increase an upward bias on the detent 144, which in turn increases its bias on the pawl detent 146 (even as the pawls 132, 134 continue to pivot inward toward a closed position). In other words, as the pawls 132, 134 are closed, the bias on them to open increases.

As the sling stud locking mechanism 110 continues to rotate in the first direction, the pivot holder 124 continues to descend further pulling the pawls 132, 134 inward and clamping them into a horizontal aperture in the sling stud (not shown) until a fully closed position is reached at FIG. 12C and the bipod is secured to the sling stud and hence the firearm.

From the closed position in FIG. 12C, the sling stud locking mechanism 110 can be rotated in a second direction to cause the pivot holder 124 to move upward. One can see how upward movement of the pivot holder 124 causes the detent 144 to first contact the pawl detent 146 since at this angle, the pawl detent 146 sits lower in the system than the pawl groove 147. As this upward movement continues, the detent 144 can interact with an angled side of the pawl detent 146 and cause the pawls 132, 134 to pivot outward (or begin to open) as they move upward and clear a top of the aperture 114. This outward pivoting can be caused by upward pressure from the detent 144 on the pawl detent 146 (clockwise in FIG. 11 for pawl 134). As the pivot holder 124 rises further and the pawls 132, 134 further clear the top of the aperture 114, the detent 144 continues to force the spring-loaded pawls 132, 134 toward the open position until they reach the position shown in FIG. 12A. Here, the biasing component 142 is at a maximum extension for the three figures in FIG. 12, though it still may remain under some compression such that an upward bias remains on the detent 144.

A bottom outer edge of each pawl 132, 134 may include an angled surface that aligns with a top of the pivot holder 124 when the pawls 132, 134 are fully-opened, as best seen in FIGS. 10 and 12A. These angled surfaces can prevent overextension of the pawls 132, 134 (i.e., prevent excessive outward pivoting). For instance, in FIG. 12A, the pawls 132, 134 are not able to pivot any further outward. In some embodiments, only one of the pawls 132, 134 may include this angled surface at the bottom outer edge.

While FIGS. 10-12 show a specific irregular bottom surface to the detent 144 that may include a pawl detent 146 and a groove detent 147, other irregular surfaces can also be implemented as long as a rotational bias (or torque) is maintained on the pawls 132, 134 throughout a range of vertical motion of the pivot holder 124.

In FIGS. 7-12 only a single pawl detent 146 and pawl groove 147 are visible, however the other pawl may or may not also include its own pawl detent 146 and pawl groove 147. A bottom surface of either or both of the pawls 132, 134 can be described as irregular as shown throughout the figures.

A clevis 125 (see FIG. 7) can prevent the sling stud clasp assembly 112 and the sling stud locking mechanism 110 from pulling apart and decoupling when the sling stud locking mechanism 110 is rotated in a second direction (e.g., a loosening direction). FIGS. 10 and 11 show the wider soft flange 115*a* shown in the left of FIG. 3, though other sizes and shapes of soft flanges can be implemented without departing from the scope of this disclosure (e.g., the narrower soft flange 115*b*).

FIG. 8 illustrates the pivot holder 124, pivot pin 138, and pawls 132, 134 in isolation with a sling stud 120. The pawls 132, 134 are in an open position, but one can see how the protrusions 122, 123 are aligned to enter a horizontal aperture through the sling stud 120.

Figure 9:
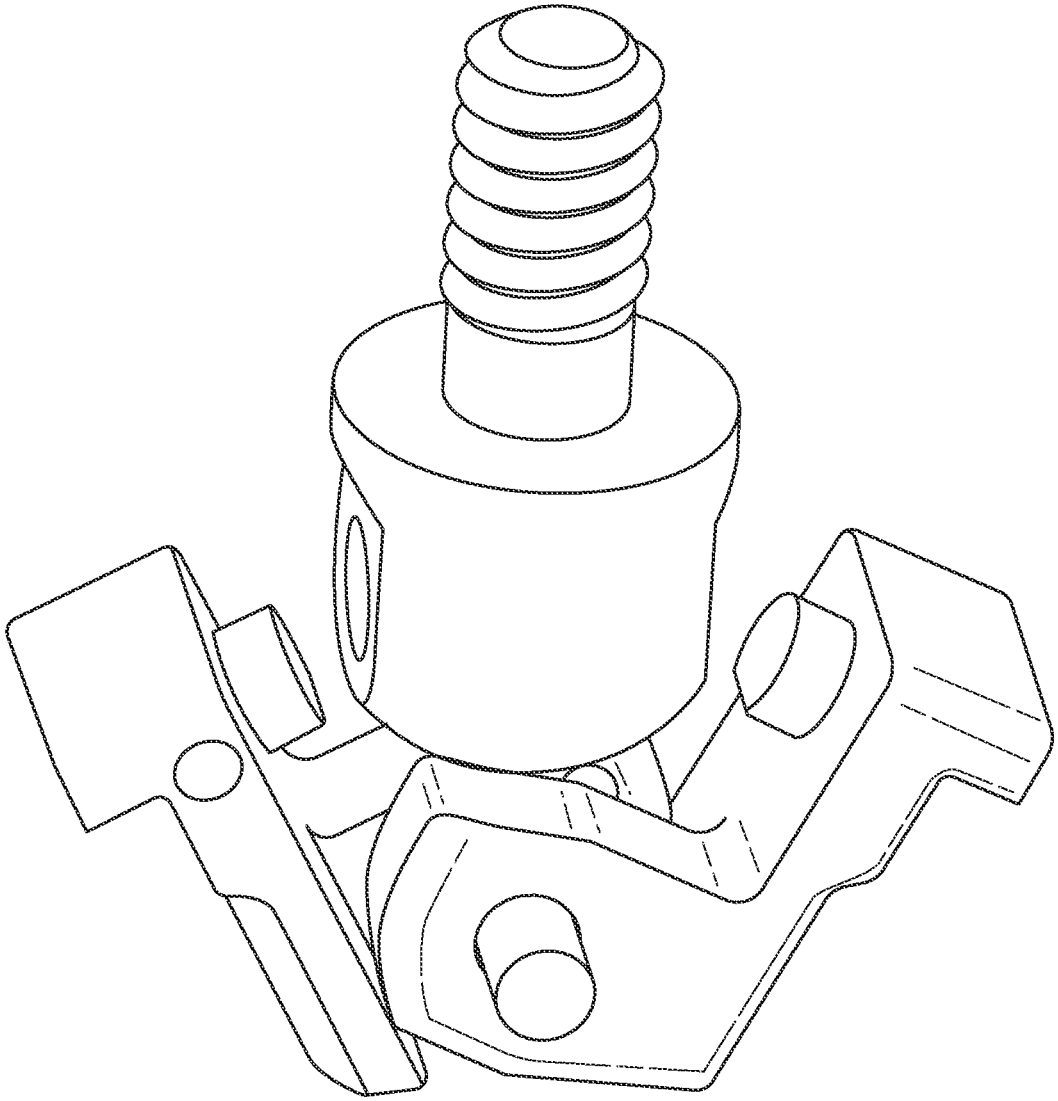
FIG. 9 illustrates another view of the pawls, pivot pin, and sling stud shown in FIG. 8.

FIG. 9 illustrates another view of the pawls 132, 134, pivot pin 138, and sling stud 120 shown in FIG. 8.

It should be understood that the detent 146 and groove 147 are just one example of an interface structure between the spring-loaded pawls 132, 134 and the detent 144, and other interfaces are also contemplated without departing from the scope of this disclosure. Further, although the detent 144 is shown as a sphere, in other embodiments, a cylindrical plunger or curved component could also be implemented. In another embodiment, part of the detent 144 could be curved or even spherical, while another portion could be cylindrical (e.g., a lower portion could be cylindrical and an upper portion could be curved). For instance, the detent 144 could have a "bullet" shape.

Non-limiting examples of the biasing component include, a compression spring, a conical spring, a coil spring, leaf spring, disc or Bellevile spring, barrel spring, elliptical helical spring, volute spring, and a pneumatic plunger. Non-limiting examples of the detent 144 include a curved or spherical detent, a cylindrical detent, and a pointed detent.

Figure 13:
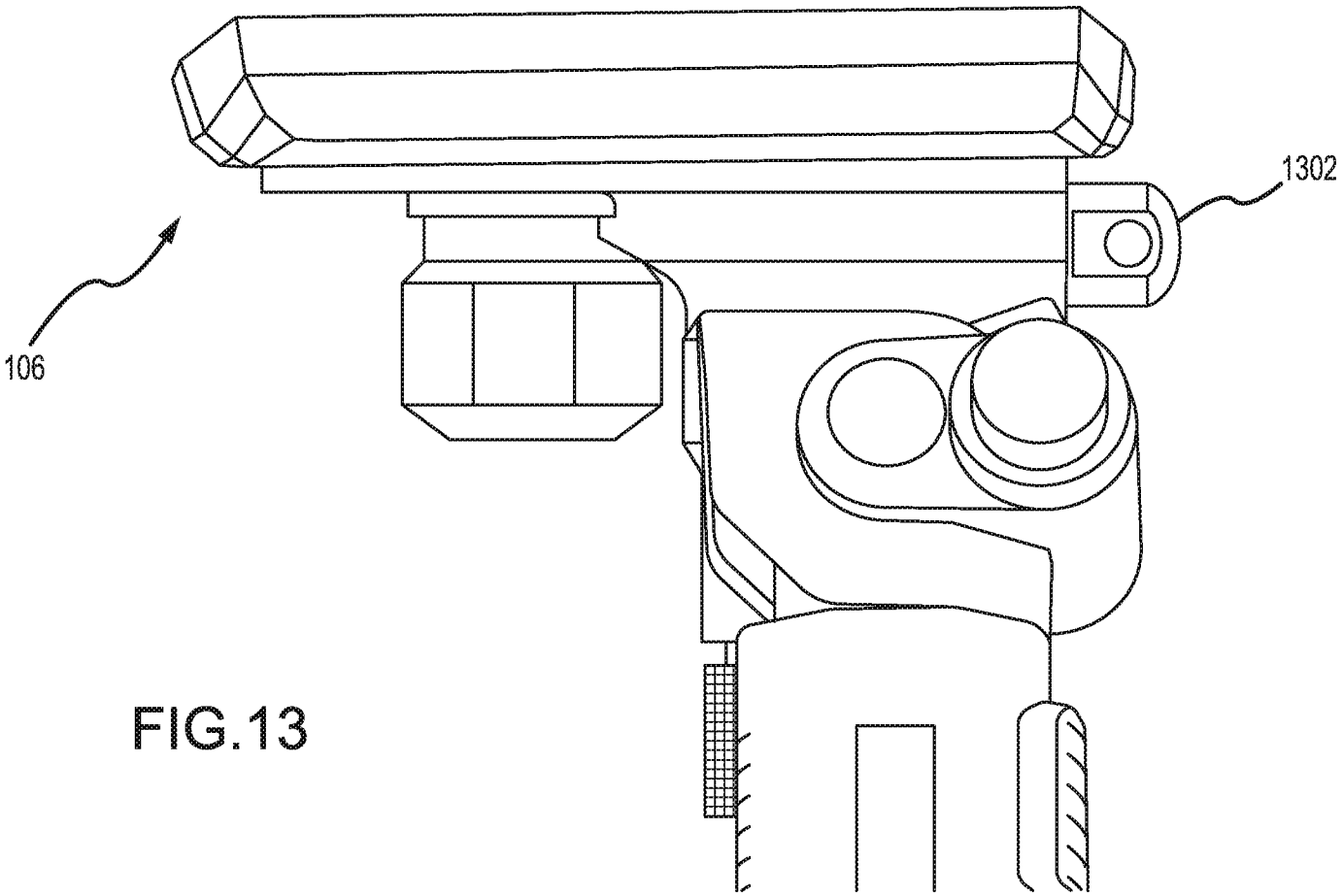
FIG. 13 shows a profile view of the firearm forend interface and a sling stud extending rearward from a rear of the firearm forend interface.
Figure 14:
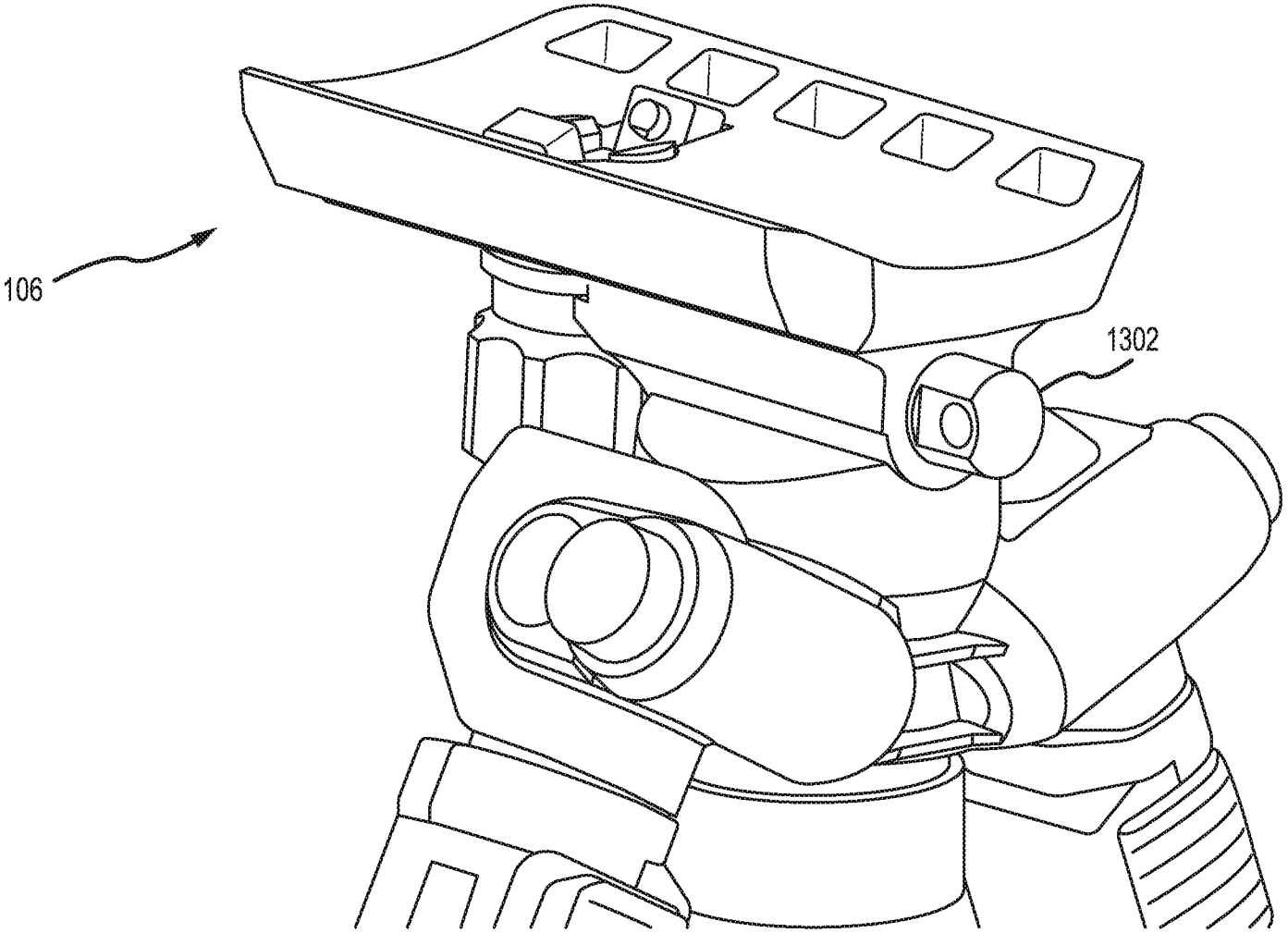
FIG. 14 shows an isometric view of a left, top, rear of the firearm forend interface in FIG. 13.

FIG. 13 shows a profile view of the firearm forend interface 106 and a sling stud 1302 extending rearward from a rear of the firearm forend interface 106. FIG. 14 shows an isometric view of a left, top, rear of the firearm forend interface 106. Although the sling stud 1302 is shown extending rearward parallel to a longitudinal axis of the firearm barrel, in other embodiments, any angle oblique to the firearm sling stud 120 can be used, and the sling stud 1302 can be arranged on other portions of the firearm forend interface 106. However, given the location of the firearm forend, the bipod legs 102, and the sling stud locking mechanism 110, as well as the fact that slings tend to also be coupled to a fixture toward the rear of the firearm, a rearward position for the sling stud 1302 may be optimal for user access as well as optimal alignment with tension forces from a sling.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A bipod comprising:

a housing;

legs coupled to the housing;

a sling stud clasp assembly coupled to the housing via an interface, the sling stud clasp assembly comprising:

a sling stud locking mechanism; and a pivot holder rotatingly engaged with the sling stud locking mechanism, the pivot holder having a pivot axis, wherein the sling stud clasp assembly has a closed position and an open position controlled by rotation of the sling stud locking mechanism, the closed position configured to secure a sling stud to the bipod; and a knob configured to rotatably tighten or loosen interplay between the housing and a pivot block and thereby allow or restrict cant between the housing and the sling stud, the knob and pivot holder aligned along a common axis.

2. The bipod of claim 1, wherein the pivot holder has a lower portion that is threadingly engaged with the sling stud locking mechanism.

3. The bipod of claim 1, wherein the pivot holder has a cylindrical section having a pivot pin aligned with the pivot axis, the pivot pin pivotally coupling two pawls to each other and to the pivot holder.

4. The bipod of claim 3, wherein the two pawls clamp toward each other when the pivot axis moves in a first direction and pivot outward when the pivot axis moves in a second direction.

5. The bipod of claim 1, wherein rotation of the sling stud locking mechanism about a longitudinal axis of the pivot holder is configured to adjust the pivot axis along the longitudinal axis, wherein the longitudinal axis is oblique or perpendicular to the pivot axis, and wherein the sling stud clasp assembly is configured to capture the sling stud when the pivot axis moves in a first direction and to release the sling stud when the pivot axis moves in a second direction opposite to the first direction.

6. The bipod of claim 1, wherein a longitudinal axis of the pivot holder is substantially parallel to the common axis.

7. The bipod of claim 1, wherein the sling stud clasp assembly further comprises spring-loaded pawls, and wherein rotation of the sling stud locking mechanism in a first direction causes the spring-loaded pawls to close.

8. The bipod of claim 1, wherein rotation of the knob is configured to allow or restrict rotation between the housing and the sling stud.

9. The bipod of claim 1, wherein the sling stud locking mechanism is a second knob.

10. The bipod of claim 1, wherein the interface is a firearm forend interface.

* * * * *